United States Patent [19]

Leyland et al.

[11] Patent Number: 4,893,555

[45] Date of Patent: Jan. 16, 1990

[54] HOT FOIL PRINTING

[75] Inventors: Alan J. Leyland; Brian C. A. Scorgie, both of Merseyside, England

[73] Assignee: Delco Electronics Overseas Corp., Detroit, Mich.

[21] Appl. No.: 285,685

[22] Filed: Dec. 16, 1988

[30] Foreign Application Priority Data

Jan. 12, 1988 [GB] United Kingdom ..... 8800596

[51] Int. Cl.[4] ..... B41F 1/07

[52] U.S. Cl. ..... 101/29

[58] Field of Search ..... 101/29, 4, 9, 11, 17, 101/21, 27, 31, 32, 6, 7, 8

[56] References Cited

U.S. PATENT DOCUMENTS

| | | | |
|---|---|---|---|
| 2,887,051 | 5/1959 | Maunder | 101/27 |
| 3,608,480 | 9/1971 | Sciame | 101/11 |
| 3,816,207 | 6/1974 | Robertson et al. | 101/9 |
| 3,960,257 | 6/1976 | High et al. | 101/4 |
| 4,502,381 | 3/1985 | Liguori | 101/7 |

FOREIGN PATENT DOCUMENTS

| | | | |
|---|---|---|---|
| 0033646 | 2/1987 | Japan | 101/7 |
| 553127 | 6/1977 | U.S.S.R. | 101/7 |

*Primary Examiner*—E. M. Eickholt

*Attorney, Agent, or Firm*—Robert J. Wallace

[57] ABSTRACT

Hot foil printing apparatus (10) for printing letters, etc. on a surface of a plastics substrate in which the surface of the plastics substrate is presented to a heated die (16) and a printing tape (24) is compressed between the surface of the plastics substrate and the heated die to print the letters on the plastics substrate, and in which the surface of the plastics substrate is heated by heating apparatus (42) before it is presented to the heated die. Provides improved print quality and quicker throughput.

11 Claims, 1 Drawing Sheet

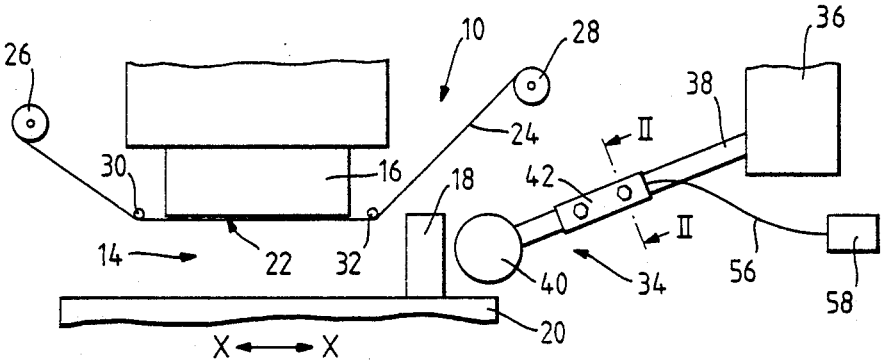
Fig. 2.
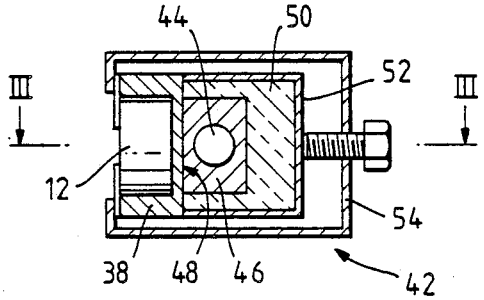
Fig. 3.
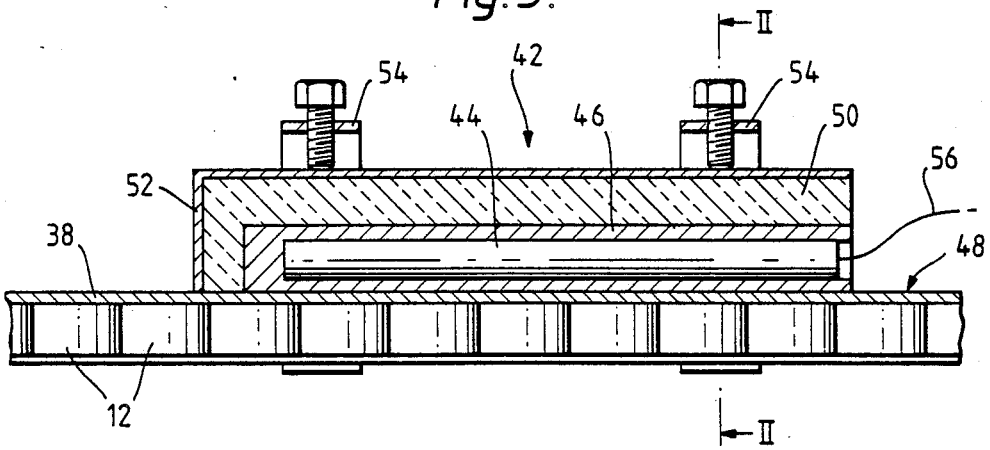

HOT FOIL PRINTING

FIELD OF THE INVENTION

This invention relates to hot foil printing apparatus, and a method of hot foil printing.

BACKGROUND OF THE INVENTION

It is known to print letters or other devices on to the surface of a substrate of plastics material by hot foil printing. In this known arrangement, the substrate is moved along by transfer means to a workstation at which a printing tape having printing material thereon is compressed between the surface of the substrate and a heated die. The heated die has a print pattern in the form of letters or other devices formed in reverse thereon. On compression of the printing tape, the printing material is transferred from the printing tape to the surface of the substrate to form the letters or other devices thereon. It has been found that small blemishes (for example, depressions as small as 0.01 mm) in the surface of the substrate can seriously affect the quality of the print.

SUMMARY OF THE INVENTION

It is an object of the present invention to overcome this known problem.

To this end, a hot foil printing apparatus in accordance with the present invention for printing letters or other devices on a surface of a plastics substrate comprises a workstation comprising a heated die having an outer surface with a print pattern thereon, a printing tape positioned adjacent the outer surface of the heated die and having a printing material thereon on the opposite side of the printing tape to the outer surface of the heated die, and holding means for securing the plastics substrate and for presenting the surface of the plastics substrate to the heated die such that the printing tape can be compressed between the surface of the plastics substrate and the outer surface of the heated die; and transfer means for moving the plastics substrate from a stored position to a second position in which the plastics substrate can be secured by the holding means; wherein the transfer means includes heating apparatus for heating the surface of the plastics substrate, such that the temperature of the surface of the plastics substrate is above room temperature when presented to the heated die.

Preferably, the heating apparatus comprises a cartridge heater which is electrically powered and thermostatically controlled to operate at a substantially constant temperature. Alternatively, the heating apparatus may comprise a flat band or strip heater which is electrically powered and thermostatically controlled to operate at a substantially constant temperature. As further alternatives, the heating apparatus may comprises a hot air blower or a radiant heater.

The transfer means preferably comprises a bowl for storing the plastics substrates, a chute for moving the plastics substrates from the bowl, and a rotatable transfer plate for moving the plastics substrates from the chute to the second position.

Preferably, the holding means comprises a mandrel for securing one of the plastics substrates, a mandrel holder for supporting the mandrel, and a track along which the mandrel holder can move between the second position of the plastics substrate and the heated die.

The present invention further includes a method of hot foil printing for printing letters or other devices on to a surface of a plastics substrate, comprising the steps of moving the plastics substrate from a stored position to a second position; securing the plastics substrate at the second position by holding means; presenting the plastics substrate by means of the holding means to an outer surface of a heated die having a print pattern thereon; and compressing a printing tape having printing material thereon between the surface of the plastics substrate and the outer surface of the heated die to transfer the printing material from the printing tape to the surface of the plastics substrate to form the letters or other devices thereon; wherein the method includes the step of heating the surface of the plastics substrate before it is presented to the heated die, such that the surface of the plastics substrate is above room temperature when the plastics substrate is presented to the heated die.

Preferably, the temperature of the surface of the plastics substrate is above 30° C.

The present invention has particular application in the printing of the numerals on substrates in the form of the plastics odometer wheels used in motor vehicles. The present invention is not restricted to such an application.

BRIEF DESCRIPTION OF THE DRAWING

The present invention will now be described, by way of example, with reference to the accompanying drawings, in which:

FIG. 1 is a schematic diagram of a hot foil printing apparatus in accordance with one embodiment of the present invention;

FIG. 2 is a cross-sectional view of the heating apparatus of the hot foil printing apparatus of FIG. 1 on the line II—II of FIGS. 1 or 3; and FIG. 3 is a cross-sectional view on the line III—III of FIG. 2.

DETAILED DESCRIPTION

Referring to FIG. 1, the hot foil printing apparatus 10 shown is for printing numbers on the peripheral surface of plastics odometer wheels 12 (FIGS. 2 and 3). The hot foil printing apparatus 10 comprises a workstation 14 comprising a heated die 16 and holding means in the form of a mandrel holder 18 laterally movable in the direction X—X along a track 20. The heated die 16 has a print pattern in the form of numbers (not shown) formed on an outer surface 22 thereof which stand proud of the outer surface, which are in the same order as to appear on the odometer wheel, and which are reversed (that is, in mirror image). The heated die 16 normally operates at temperatures in excess of 200° C., and is usually set to operate at a temperature between 260° and 300° C.

The hot foil printing apparatus 10 also comprises a printing tape 24 which is fed from an input spool 26 to a driven take-up spool 28 by way of two guides 30,32. The printing tape 24 preferably comprises a polyester film or other suitable material which acts as a carrier for a printing material in the form of a freely releasing pigment which is coloured as required. Between the two guides 30,32, the printing tape 24 passes the outer surface 22 of the heated die 16 with the polyester film adjacent the outer surface, and with the printing material on the opposite side of the printing tape to the heated die.

The hot foil printing apparatus 10 further comprises transfer means 34 comprising a bowl 36, a chute 38, and a rotatable transfer plate 40.

When the hot foil printing apparatus 10 is in use, the plastics odometer wheels 12 are temporarily stored in the bowl 36 and are fed down the chute 38 to the rotatable transfer plate 40. The rotatable transfer plate 40 moves a plastics odometer wheel 12 from the end of the chute 38 and presents it at a second position to a mandrel (not shown) on the mandrel holder 18, on which the plastics odometer wheel can be secured. The mandrel holder 18 then moves along the track 20. As the mandrel holder 18 passes the heated die 16, the peripheral surface of the plastics odometer wheel 12 secured on the mandrel presses against, and rotates along, the outer surface 22 of the heated die 16, with the printing tape 24 compressed between the print pattern on the heated die and the plastics odometer wheel. As the plastics odometer wheel 12 rotates along the heated die 16, the pigment on the printing tape 24 is transferred from the printing tape to the peripheral surface of the plastics odometer wheel to print the numbers thereon.

The arrangement of the rotatable transfer plate 40 and the mandrel (not shown) on the mandrel holder 18 is such as to ensure that each plastics odometer wheel 12 is presented to the heated die 16 in the required orientation, thereby ensuring that the numbers are printed in the required position on the odometer wheels.

The apparatus and method as thus far described is known. However, a problem with this arrangement has been encountered when the peripheral surface of the plastics odometer wheels 12 has small blemishes (for example, indentations of 0.01 mm or more) in that the quality of the print significantly decreases, resulting in a large amount of scrap material. Attempts at running the hot foil printing apparatus at half its usual running speed failed to improve the quality of the printing.

The improvement in accordance with the present invention is provided by heating the surface of the plastics substrate before it is presented to the heated die so that the surface is warm (above room temperature) when it is presented to the heated die. In the embodiment described with reference to FIGS. 1 to 3, the heating is provided by heating apparatus 42 secured to the chute 38. The heating apparatus 42 comprises a cartridge heater 44 held in a metallic holder 46 which is in contact with an outer surface 48 of the chute 38. The heat generated by the cartridge heater 44 is transferred to the peripheral surface of the plastics odometer wheels 12 by way of the metallic holder 46 and the chute 38 (which is also of metallic material). The heating apparatus 42 also comprises a layer 50 of heat insulating material which partially surrounds the metallic holder 46, and an outer metallic shroud 52. The heating apparatus 42 is held in place by two clamps 54. The cartridge heater 44 is connected by electrical leads 56 to a control unit 58, which electrically powers and thermostatically controls the cartridge heater such that the cartridge heater is held at a substantially constant temperature. In this particular embodiment, the cartridge heater 44 was heated to a temperature which provides a temperature range on the chute 38 of 40° to 60° C.

Using this invention, the temperature of the peripheral surface of the plastics odometer wheels 12 when presented to the heated die 16 for printing is above room temperature, and preferably above 30° C. It has been found that, when using the present invention, the quality of the print increased significantly when printing plastics odometer wheels 12 having small blemishes in their peripheral surfaces even at the usual running speed of the apparatus, and the amount of scrap was significantly reduced. A further advantage was found in that the speed of printing could be increased by up to 25% above the usual running speed without the quality of the print deteriorating for both the blemished and unblemished odometer wheels.

It is believed the improvement arises because in the previously known method of presenting a cold (room temperature) plastics substrate to the heated die, the cold plastics substrate acted as a heat sink, which affected the temperature of the heated die, and consequently the quality of the print. In the previously known method, the quality of the print was very much dependent on the heated die temperature, and the temperature of the heated die had to be set within very fine tolerances. An additional advantage of the present invention is that the temperature setting of the heated die does not have to be so finely adjusted in order to achieve a good quality print.

Although the heating apparatus 42 described with reference to the drawings comprises a cartridge heater 44 secured to the chute 38, the present invention is not restricted to such an arrangement. Other forms of heating apparatus have also been found to provide the above mentioned improvements. For example, hot air directed at the chute 38 and/or the rotatable transfer plate 40 also provided an improvement, as did a radiant heater directing heat at the chute and/or rotatable transfer plate. Another alternative is to provide an electrically operated flat band or strip heater attached to the chute.

The present invention can also provide improved quality and throughput when used for hot foil printing on other plastics substrates besides plastics odometer wheels. The present invention can be used on substrates made from any suitable plastics material, such as acetal resin, acrylic, polycarbonate, acrylonitrile butadiene styrene (ABS), polystyrene, etc.

The embodiments of the invention in which an exclusive property or privilege is claimed are defined as follows:

1. A hot foil printing apparatus for printing letters or other devices on a surface of a plastics substrate, the hot foil printing apparatus comprising a workstation comprising a heated die having an outer surface with a print pattern thereon, a printing tape positioned adjacent the outer surface of the heated die and having a printing material thereon on the opposite side of the printing tape to the outer surface of the heated die, and holding means for securing the plastics substrate and for presenting the surface of the plastics substrate to the heated die such that the printing tape can be compressed between the surface of the plastics substrate and the outer surface of the heated die; and transfer means for moving the plastics substrate from a stored position to a second position in which the plastics substrate can be secured by the holding means; characterised in that the transfer means includes heating apparatus in close antecedent proximity to the heated die for heating the surface of the plastics substrate immediately prior to presentation to the heated die, such that the temperature of the surface of the plastics substrate is above room temperature when presented to the heated die.

2. A hot foil printing apparatus as claimed in claim 1, wherein the heating apparatus comprises a cartridge heater which is electrically powered and thermostatically controlled to operate at a substantially constant temperature.

3. A hot foil printing apparatus as claimed in claim 1, wherein the heating apparatus comprises a flat band or strip heater which is electrically powered and thermostatically controlled to operate at a substantially constant temperature.

4. A hot foil printing apparatus as claimed in claim 1, wherein the heating apparatus comprises a hot air blower.

5. A hot foil printing apparatus as claimed in claim 1, wherein the heating apparatus comprises a radiant heater.

6. A hot foil printing apparatus as claimed in claim 2, wherein the holding means comprises a mandrel for securing one of the plastics substrates, a mandrel holder for supporting the mandrel, and a track along which the mandrel holder can move between the second position of the plastics substrate and the heated die.

7. A hot foil printing apparatus for printing letters or other devices on a surface of a plastics substrate, the hot foil printing apparatus comprising a workstation comprising a heated die having an outer surface with a print pattern thereon, a printing tape positioned adjacent the outer surface of the heated die and having a printing material thereon on the opposite side of the printing tape to the outer surface of the heated die, and holding means for securing the plastics substrate and for presenting the surface of the plastics substrate to the heated die such that the printing tape can be compressed between the surface of the plastics substrate and the outer surface of the heated die; and transfer means for moving the plastics substrate from a stored position to a second position in which the plastics substrate can be secured by the holding means; characterised in that the transfer means includes a bowl for storing the plastics substrate, a chute for moving the plastics substrate from the bowl, a rotatable transfer plate for moving the plastics substrate from the chute to the second position, and heating apparatus for heating the surface of the plastics substrate, such that the temperature of the surface of the plastics substrate is above room temperature when presented to the heated die, wherein the heating apparatus comprises a cartridge heater which is electrically powered and thermostatically controlled to operate at a substantially constant temperature.

8. A hot foil printing apparatus for printing letters or other devices on a surface of a plastics substrate, the hot foil printing apparatus comprising a workstation comprising a heated die having an outer surface with a print pattern thereon, a printing tape positioned adjacent the outer surface of the heated die and having a printing material thereon on the opposite side of the printing tape to the outer surface of the heated die, and holding means for securing the plastics substrate and for presenting the surface of the plastics substrate to the heated die such that the printing tape can be compressed between the surface of the plastics substrate and the outer surface of the heated die; and transfer means for moving the plastics substrate from a stored position to a second position in which the plastics substrate can be secured by the holding means; characterised in that the transfer means includes a bowl for storing the plastics substrate, a chute for moving the plastics substrate from the bowl, a rotatable transfer plate for moving the plastics substrate from the chute to the second position, and heating apparatus for heating the surface of the plastics substrate, such that the temperature of the surface of the plastics substrate is above room temperature when presented to the heated die.

9. A hot foil printing apparatus as claimed in claim 8, wherein the heating apparatus comprises a flat band or strip heater which is electrically powered and thermostatically controlled to operate at a substantially constant temperature.

10. A hot foil printing apparatus as claimed in claim 8, wherein the heating apparatus comprises a hot air blower.

11. A hot foil printing apparatus as claimed in claim 8, herein the heating apparatus comprises a radiant heater.

* * * * *